US005621394A

United States Patent [19]

Garrick et al.

[11] Patent Number: 5,621,394

[45] Date of Patent: Apr. 15, 1997

[54] SMOKE ALARM MONITORING AND TESTING SYSTEM AND METHOD

[76] Inventors: Gilbert A. Garrick; Marie J. Garrick, both of 8 Penton Place, Gilmore, ACT, Australia, 2905

[21] Appl. No.: 631,022

[22] Filed: Apr. 12, 1996

[30] Foreign Application Priority Data

Aug. 15, 1994 [AU] Australia ..... PM 7447

[51] Int. Cl.[6] ..... G08B 17/10

[52] U.S. Cl. ..... 340/628; 340/333; 340/514; 340/693; 340/825.06; 324/429

[58] Field of Search ..... 340/628, 636, 340/511, 514, 516, 825.06, 825.77, 333, 693, 506, 629, 630; 324/429, 433

[56] References Cited

U.S. PATENT DOCUMENTS

| | | | |
|---|---|---|---|
| 3,641,570 | 2/1972 | Thompson | 340/333 |
| 4,088,986 | 5/1978 | Boucher | 340/333 |
| 4,138,670 | 2/1979 | Schneider | 340/507 |
| 4,139,846 | 2/1979 | Conforti | 340/636 |
| 4,251,811 | 2/1981 | Wittlinger | 340/636 |
| 4,290,057 | 9/1981 | Knight | 340/693 |
| 4,972,181 | 11/1990 | Fiene | 340/628 |
| 5,105,371 | 4/1992 | Shaw et al. | 340/514 |

OTHER PUBLICATIONS

International Search Report.

*Primary Examiner*—Jeffery Hofsass
*Assistant Examiner*—Timothy Edwards, Jr.
*Attorney, Agent, or Firm*—Michael D. Bednarek; Kilpatrick & Cody, L.L.P.

[57] ABSTRACT

A smoke detection and alarm system including one or more low cost battery operated smoke alarms fitted with internal non-rechargeable standby batteries, a reactive primary power supply derived from mains supply, and connecting means for connecting the reactive power supply to each of the system's smoke alarms, the system being characterized in that said reactive primary power supply comprises: means for providing a DC supply of slightly higher than the smoke alarm standby battery voltage; and means for detecting the higher than quiescent current supplied by the reactive power supply when any of the smoke alarms connected as part of the system is in alarm or in self-test mode; and means of lowering the DC supply voltage made available to power the system's smoke alarms when a higher than quiescent current is detected; and said smoke alarms comprise: means by which all the current required under quiescent condition, with primary power available, is supplied by the reactive primary power supply; and means by which a very high proportion of the current required when any of the system's smoke alarms is in self-test mode is supplied by the smoke alarm battery as the DC voltage of the reactive primary power supply drops in self-test mode; and all of the above system's characteristics resulting in: the condition of the standby battery of each smoke alarm being tested at regular intervals to provide an audible warning if the battery is depleted, disconnected or missing; and the standby battery of each smoke alarm supplying quiescent current only for very brief periods to result in the standby batteries having a longer life well in excess of the average one year life common with existing systems; and the system being of very low overall cost and of much improved reliability.

27 Claims, 6 Drawing Sheets

SMOKE ALARM MONITORING AND TESTING SYSTEM AND METHOD

INTRODUCTION

This application is a continuation-in-part application of the U.S. national phase application (for which no serial number has been assigned) of International Patent Application PCT/AU95/00493 filed 15 Aug. 1995.

This invention relates to a smoke detection and alarm system as used in buildings to provide an early warning in case of fire and to methods of monitoring and testing the integrity of such systems.

As used herein the expression "integrity" in relation to a smoke detection and alarm system is to be taken to relate to any aspect of the system which can cause the system to fail, malfunction or otherwise operate unsatisfactorily and includes the depletion, disconnection or removal of a power supply from a smoke alarm.

BACKGROUND

Smoke detection and alarm systems incorporating smoke alarms are extensively used in domestic dwellings, motels, hotels, hospitals, old people's homes and other commercial premises. Such systems are of four main types all of which present difficulties or disadvantages as follows:

Type 1

A smoke detection and alarm system comprising of low cost battery powered self-contained stand-alone smoke alarms utilizing internal batteries, usually of the 9 V non-rechargeable type, for their operation. This type of smoke alarm has a very low quiescent current and at regular intervals, normally not exceeding 60 seconds, the smoke alarm enters into a self-test mode when the current is briefly increased to a value much above the quiescent current. The electronic circuitry of the smoke alarm detects whether the battery voltage in self-test mode is above a certain threshold value. If the battery voltage is detected to be below the threshold value, normally around seven and a half volts, the smoke alarm activates an internal circuit to produce a brief audible warning indicating a low or depleted battery requiring replacement.

The difficulties/disadvantages of Type 1 smoke alarms are:

(i) The smoke alarms are powered from only one source, their internal batteries. Should the battery of a smoke alarm be removed or disconnected, the smoke alarm becomes inoperative and often this condition cannot be detected until the smoke alarm is tested. This may result in quite a dangerous situation should a fire break out whilst the smoke alarm is inoperative.

(ii) The 9 V battery is used to power the smoke alarm at all times and although Type 1 smoke alarms are designed to be very economical of batteries, the batteries only last about one year.

Type 2

A smoke detection and alarm system comprising of dual supply smoke alarms where the primary (normal) power supply is mains supply and the stand-by power supply is in the form of non-rechargeable batteries as found in Type 1 smoke alarm previously described.

In Type 2 smoke alarms, although the smoke detection functions of the smoke alarm are carried out using power from mains supply, the stand-by battery is constantly being monitored and periodically tested as described for Type 1 smoke alarms.

The difficulties/disadvantages of Type 2 smoke alarms are:

(i) The constant monitoring of the smoke alarm stand-by battery results in a small but constant current drain which effectively reduces the battery life which, again, is around one year.

(ii) The design of the smoke alarm, although offering a full battery back-up for times of mains failure, is complicated and costly due to the provision of safety features to avoid accidental and potentially lethal contact with live parts of the smoke alarm while the stand-by battery is being replaced.

(iii) Because the smoke alarms are hard wired directly to the mains wiring system, the installation of the smoke alarms is specialised and is required to be carried out by a licensed electrician, thus adding to the overall installation cost of the system.

Type 3

A smoke detection and alarm system comprising of dual supply smoke alarms as for Type 2 except that the smoke alarms stand-by batteries are of the rechargeable type.

The difficulties/disadvantages of Type 3 smoke alarms are as previously described for Type 2 smoke alarms. Type 3 smoke alarms have the further disadvantage that the rechargeable batteries are relatively expensive and require the provision of a battery charging circuit which also adds to the overall cost of the system.

Type 4

A smoke detection and alarm system comprising of dual supply smoke alarms where the primary (normal) power supply is of the extra low voltage type derived from mains supply, and the stand-by power supply is in the form of a rechargeable battery which is normally part of a separate control box/panel.

The main difficulty/disadvantage with a system comprising of Type 4 smoke alarms is that, apart from the high cost of the rechargeable battery, the system also requires a battery charger and an electronic circuit to test the battery condition. The battery testing furthermore becomes a manual function of the system so that the overall reliability of the system is greatly reduced when considering the fact that the standby batteries of Types 1, 2 and 3 smoke alarms are automatically tested at least once every minute by the smoke alarm internal electronic circuitry.

SUMMARY OF THE INVENTION

This invention in one aspect resides broadly in a method of monitoring and testing the integrity of a smoke detection and alarm system in which the smoke alarms are powered by a primary power supply, each smoke alarm having a stand-by battery power supply and being operable in a self-test mode, and alarm mode and a quiescent mode, the current drain in self-test and alarm modes exceeding the quiescent current drain, the method including:

switching the voltage supplied to the smoke alarms such that when the smoke alarms are in quiescent mode, the current drain is via the primary power supply, if available, and not via the stand-by battery power supply.

It will be appreciated that the primary power supply will not be available in circumstances when the alarm has been disconnected from the primary power supply or when the primary power supply is inoperable. In such circumstances, the current drain can only be via the stand-by battery supply.

The voltage may be switched by various means to achieve the required result. In a preferred embodiment the voltage is switched by:

providing a primary supply voltage which is slightly higher than the smoke alarm stand-by battery voltage;

detecting if a current higher than the quiescent current is supplied by the primary power supply in accordance with whether any of the smoke alarms is in alarm or self-test mode, and lowering the primary supply voltage when a current higher than the quiescent current is detected.

The method may also include:

detecting when a current higher than the quiescent current is supplied by the primary power supply for a period of time exceeding the duration of the self-test mode, and raising the primary supply voltage to its original quiescent value when it is detected that a current higher than the quiescent current is supplied by the primary power supply for a period of time exceeding the duration of the self-test mode.

It is preferred that a warning is provided if the integrity of the system is unsatisfactory. The warning may be of any suitable type such as audible or visual.

The method can include providing a dedicated conductor independent of the primary power supply for connection to all smoke alarms in the system to establish common alarm communication means therebetween.

In one embodiment the method includes supplying a test signal to the dedicated conductor whereby testing of all smoke alarms in the system is activated. The test signal can be supplied automatically after an alarm has been registered on the system or alternatively, the test signal can be supplied remotely by means of a test switch.

In another embodiment the method includes de-activating any warnings raised during testing. The warning may be de-activated automatically after a predetermined time or alternatively, the warnings can be de-activated remotely by means of a reset switch.

The method can also include:

detecting an alarm registered at any smoke alarm in the system, and supplying an alarm signal to the dedicated conductor whereby other smoke alarms in the system are activated.

In another aspect this invention resides broadly in a smoke detection and alarm system including:

a primary power supply;

a plurality of smoke alarms powered by the primary power supply, each smoke alarm having a stand-by battery power supply and being operable in a self-test mode, an alarm mode or a quiescent mode, the current drain in self-test and alarm modes exceeding the quiescent current drain, and switching means for switching the voltage supplied to the smoke alarms such that when the smoke alarms are in quiescent mode, the current drain is via the primary power supply, if available, and not via the stand-by battery power supply.

The switching means may comprise any suitable means for achieving this result and in a preferred embodiment includes:

means for providing a primary supply voltage which is slightly higher than the smoke alarm stand-by battery voltage;

means for detecting if a current higher than the quiescent current is supplied by the primary power supply in accordance with whether any of the smoke alarms is in alarm or self-test mode, and means for lowering the primary supply voltage when a current higher than the quiescent current is detected.

It is preferred that the system includes:

means for detecting when a current higher than the quiescent current is supplied by the primary power supply for a period of time exceeding the duration of the self-test mode, and means for raising the primary supply voltage to its original quiescent value when it is detected that a current higher than the quiescent current is supplied by the primary power supply for a period of time exceeding the duration of the self-test mode.

The system may also include warning means for providing a warning if the integrity of the system is unsatisfactory. The warning means can be any means suitable to warn that the integrity of the system is unsatisfactory including audible and visual warning means.

In a preferred embodiment the system includes a dedicated conductor independent of the primary power supply for connection to all smoke alarms in the system to establish common alarm communication means therebetween.

In a preferred embodiment the system includes test signal supply means for supplying a test signal to the dedicated conductor whereby testing of all smoke alarms in the system is activated. The test signal supply means can supply the test signal automatically after an alarm has been registered on the system. Alternatively test switch means can supply the test signal remotely.

The system can also include de-activating means for de-activating any warnings raised during testing. The de-activating means can de-activate the warnings automatically after a predetermined time, or alternatively reset switch means can de-activate the warnings remotely.

The system can also include remote alarm activation means for detecting an alarm registered at any smoke alarm in the system and supplying an alarm signal to the dedicated conductor whereby other smoke alarms in the system are activated.

In a preferred embodiment the system includes connection means for connecting said smoke alarms and said switching means to a mains power supply system. The connection means may be a plugpack so that connection to the mains supply system is non-specialised, simple and does not require the services of a licensed electrician or engineer.

In a further aspect this invention resides in a smoke detection and alarm system including one or more low cost battery operated smoke alarms fitted with internal non-rechargeable stand-by batteries, a reactive primary power supply derived from mains supply, and connecting means for connecting the reactive primary power supply to each of the system smoke alarms, the system being characterised in that (1) the reactive primary power supply comprises:

(a1) means for providing a d.c. supply of slightly higher voltage than the smoke alarm stand-by battery voltage; and (a2) means for detecting the higher the quiescent current supplied by the reactive primary power supply when any of the smoke alarms connected as part of the system is in alarm or self-test mode; and (a3) means of lowering the d.c. supply voltage made available to power the system smoke alarms when a higher than quiescent current is detected; and (2) the smoke alarms comprise:

(b1) means by which all the current required under quiescent condition, with primary power available, is supplied by the reactive primary power supply; and (b2) means by which a very high proportion of the current required when any one of the system smoke alarms is in self test mode is supplied by the smoke alarm battery as the d.c. voltage of the reactive primary power supply drops in self test mode; and (3) all the above system characteristics resulting in:

(c1) the condition of the stand-by battery of each smoke alarm being tested at regular intervals to provide an audible warning if the battery is depleted, disconnected or missing; and (c2) the stand-by battery of each smoke alarm supplying current only for very brief periods to result in the stand-by batteries having a longer life well in excess of the average one year life common with existing systems; and (c3) the system being of very low overall cost and of much improved reliability.

As used herein the expression "reactive" in relation to the primary power supply is to be taken to mean that the power supply voltage supplied to the smoke alarms reacts or responds to, or is reactive or responsive to, the current detected or to other circuit conditions. It does not mean that the power supply is reactive in the sense that the power supply supplies reactive power.

The reactive primary power supply can further comprise:

(a4) means of raising the d.c. supply voltage made available to power the system smoke alarms to its original quiescent value when a higher than quiescent current is detected for a period of time exceeding the duration of the self-test period; and the smoke alarms can further comprise:

(b3) means by which the higher than quiescent current following an alarm being raised, after a short initial period exceeding the duration of the self-test period, is caused to be supplied exclusively to the reactive primary power supply for the remainder of the alarm period.

DESCRIPTION OF THE PREFERRED EMBODIMENTS

Embodiments of the invention are described in detail in the following subsections of the specification and as illustrated by the accompanying drawings. The drawings, however, are merely illustrative of how the invention might be put into effect and are not to be understood as limiting on the invention.

First Embodiment

Figure 1:
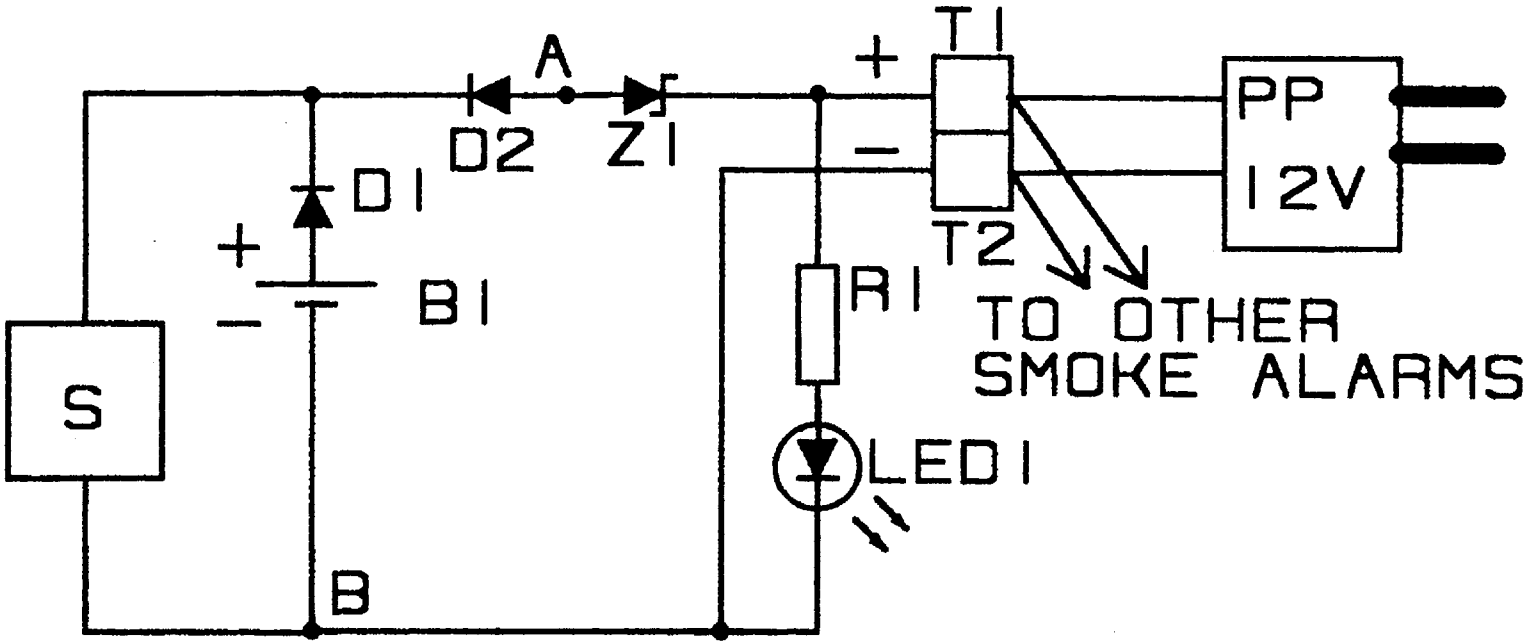
FIG. 1 is a circuit diagram of a first embodiment of the invention.

In a simple form of the invention, the system is wired as in FIG. 1.

Under quiescent conditions the mains powered ELV reactive primary supply consisting of plugpack PP and zener diode Z1 supplies power continuously to the smoke alarm S at approximately 10 V d.c. The voltage is derived in the following manner:

(i) The voltage output of the plugpack is around 12 V d.c.

(ii) The voltage drop across Z1, nominally rated at 4.7 V is only about 1.5 to 2 V under the very low quiescent current conditions. This drop of voltage results in Point A of FIG. 1 being at approximately 10 V under quiescent conditions.

Under quiescent conditions, the 10 V available at point A is higher than the voltage of the stand-by battery B1. This results in diode D2 conducting to allow the primary supply to power the smoke alarm whilst diode D1 is reversed biased and no current is supplied by the battery.

When the smoke alarm enters into self-test mode, the current increases briefly to a value much higher than the quiescent current causing the voltage dropped across Z1 to increase. This results in the following:

Battery missing or not connected

If the stand-by battery is missing from the smoke alarm, or is not connected, the voltage dropped across Z1 increases to the full 4.7 V at which the zener diode is rated. This results in the voltage at point A dropping to approximately seven volts which is below the low voltage threshold value of the smoke alarm. The smoke alarm electronic circuitry, having sensed this low voltage when in self-test mode, gives an audible warning to indicate the battery is missing or disconnected.

Battery low or defective

If the battery is low or defective, the higher current in self-test mode is supplied mainly by the battery as both the battery voltage and the voltage at point A drop under increased current drawn by the smoke alarm. The voltage at point C therefore drops to a value lower than the low voltage threshold value and the smoke alarm provides an audible warning to indicate that the battery is low or defective.

If the battery is a healthy one, the voltage at point C will also drop as previously described but the lower voltage then available remains above the smoke alarm low voltage threshold value and no audible warning is emitted. LED1, in series with resister R1, provides an indication at the smoke alarm that power from the primary supply is available. Diode D2 prevents the LED from being operated by the battery when the primary supply fails.

Alarm Condition

Under alarm conditions, the current drawn by the smoke alarm fluctuates with the intermittent beeping of the smoke alarm sounder. This results in high current pulses during which the smoke alarm operation is similar to its operation in self-test mode. It should be noted however that irrespective of whether the stand-by battery is missing, low or not connected, the lower voltage made available by the reactive primary power supply under high current conditions is adequate to allow the smoke alarm to operate normally in self-test and alarm modes. This is also true for all subsequent forms of the invention.

Referring to FIG. 1, apart from plugpack PP, all components including terminals T1 and T2, are in or on the smoke alarm device itself as an "add-on" circuit to the smoke alarm original electronic circuit. Alternatively, the components can be incorporated as part of the internal electronic circuit of the smoke alarm at time of manufacture.

It should also be noted that one limitation of this simple form of the invention is that, if a battery is fitted to the smoke alarm which is in good condition, under alarm conditions most of the current drawn by the smoke alarm device under high intermittent current pulses is supplied by the stand-by battery and not by the reactive primary power supply. This limitation is overcome in subsequent forms of this invention described in later sections of this application.

Figure 2:
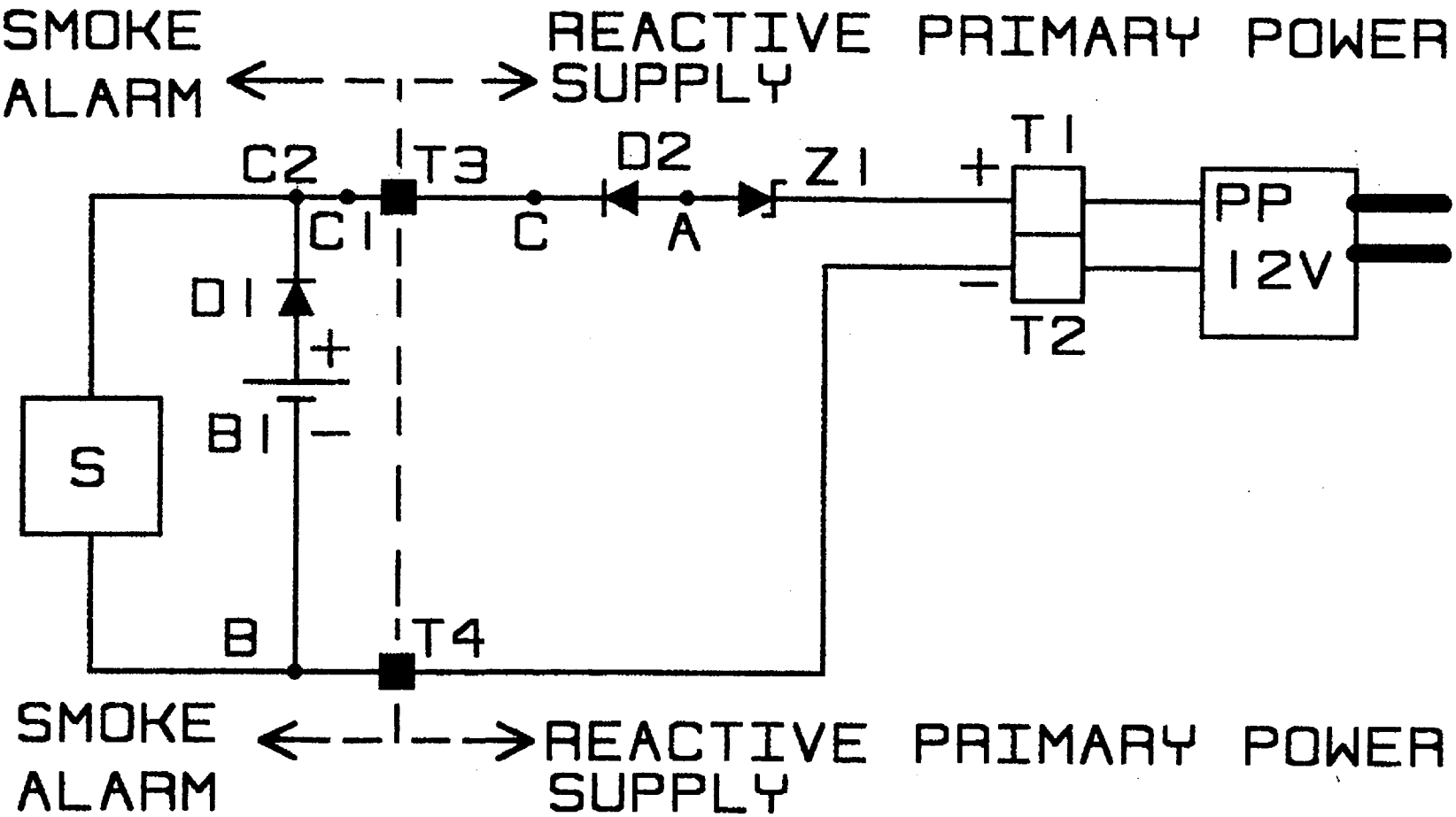
FIG. 2 is a circuit diagram of the first embodiment with connection to a separate reactive primary power system for a plurality of smoke alarms.

To reduce the total number of components and minimize costs, it may be preferable, if the system includes more than one smoke alarm, to build the reactive primary power supply totally separate from the smoke alarm. The system is then wired as shown in FIG. 2 whose operation is essentially the same as that for the system according to FIG. 1 with the exception of:

(i) components R1 and LED1 for reactive power on indication are removed; and (ii) all smoke alarms are wired in parallel from terminals T3 and T4 of the reactive primary power supply. If an indication of external power availability is required in this system configuration, an LED can be provided in series with each smoke alarm reactive primary power supply line, between points C1 and C2 within each smoke alarm, which will glow when its corresponding smoke alarm is in self-test mode if external reactive primary power is available. If this option is chosen, diode D2 becomes redundant.

Diodes D1, D2 and zener diode Z1 thus constitute switching means such that when the voltage at point A drops below the voltage of stand-by battery B1 under self-test conditions the current drain is mainly via the stand-by battery B1 rather than via the primary power supply, whereas under quiescent conditions the current drain is via the primary power supply rather than via stand-by battery B1.

Second Embodiment

Figure 3:
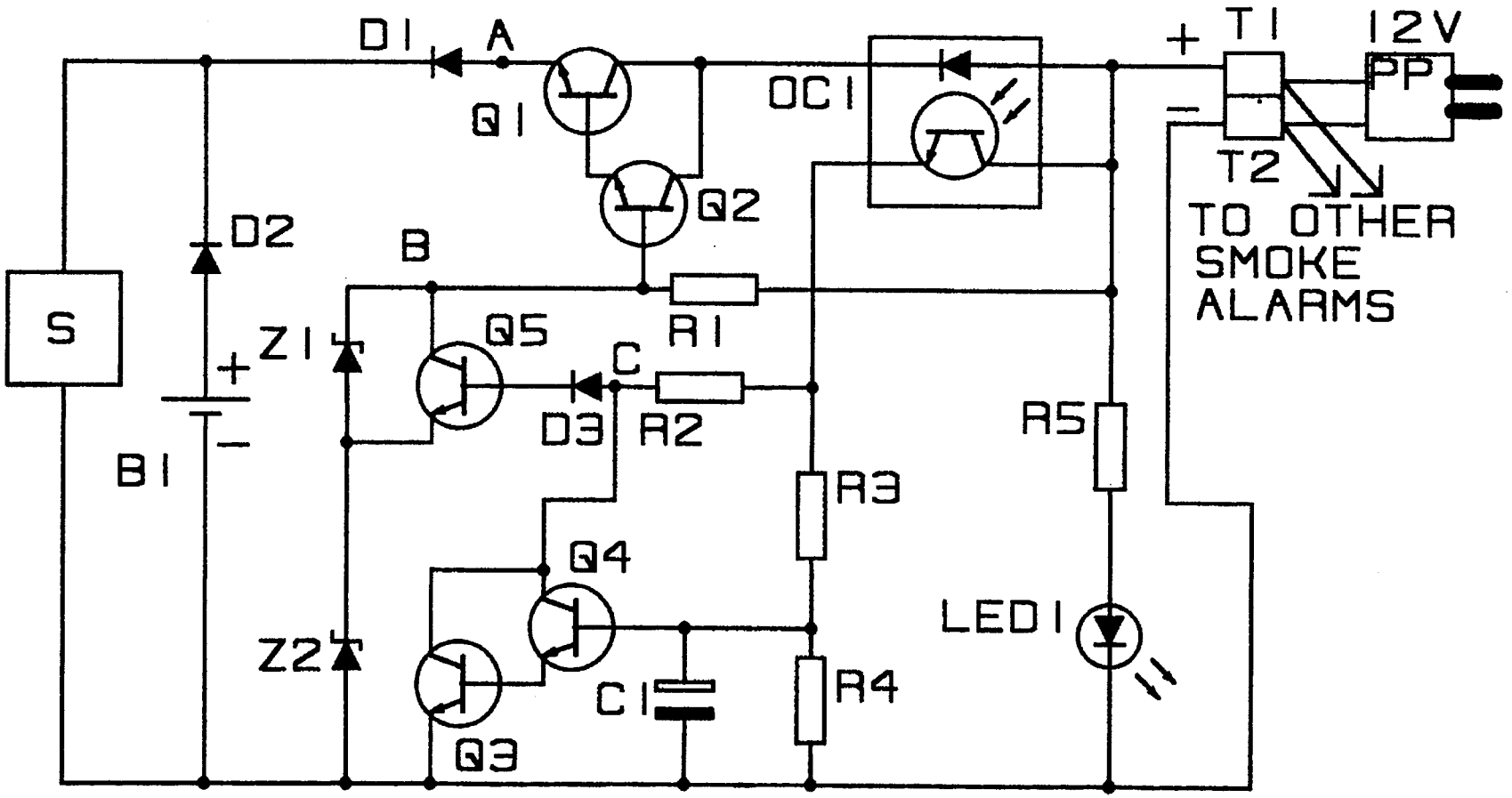
FIG. 3 is a circuit diagram of a second embodiment of the invention.

In this form of the invention, the system is wired as in FIG. 3 to overcome the limitation of the previously described system where most of the high intermittent current pulses, under alarm conditions, are supplied by the stand-by battery of the smoke alarm. According to FIG. 3, the reactive primary power supply consists of all components of FIG. 3 with the exception of smoke alarm S, diode D2 and battery B1.

Referring to FIG. 3, under quiescent conditions the current in the diode section of optocoupler OC1 is negligible resulting in the photo-transistor of OC1 being turned off. Therefore transistors Q5, Q3 and Q4 are also turned off resulting in resistance R1 being effectively connected in series with zener diodes Z1 and Z2 across the 12 V d.c. supply of plugpack PP. The voltage at point B, which is equal to the zener voltage ratings of Z1 and Z2, is applied to the base of transistor Q2 causing both Q2 and Q1 to conduct to provide approximately 9.5 V d.c. at point A. Since this voltage is higher than the voltage of the stand-by battery B1, diode D2 is reversed biased resulting in the battery not supplying any current to the smoke alarm. The current then is supplied to the smoke alarm through diode D1 from the reactive primary supply.

Under the brief self-test mode, the higher current drawn by the smoke alarm causes the photo-transistor section of OC1 to conduct thus instantly turning on Q5 by providing it with base current through R2 and D3. As Q5 conducts, Z1 is effectively by-passed and the voltage at point B is then equal to the sum of the zener voltage of Z2 and the collector to emitter voltage of Q5.

The voltage at point A under self-test mode is less than the low voltage threshold of the smoke alarm and is typically around seven volts.

Battery missing or not connected

If the battery is missing or is not connected, all the current under self-test mode is supplied by the reactive primary power supply and the smoke alarm senses the drop in voltage, which is now below the low battery threshold voltage, to emit a battery missing audible warning or indication.

Battery low and needs replacement

If the battery is low, the current under self-test mode is supplied by the battery and to a much lesser extent, by the primary supply. As the battery is not a healthy one, the voltage applied to the smoke alarm drops to a voltage lower than the value of the low battery threshold voltage of the smoke alarm which therefore emits an audible warning to indicate a low battery.

It should be noted that when the smoke alarm is in self-test mode, capacitor C1 is being charged through resistor R3. However, since the self-test period is very brief, the voltage at the base of transistor Q4 does not rise sufficiently to cause Q4 and Q3 to conduct and they are therefore ineffective during self-test mode. Charging of capacitor C1 ends at the end of the self-test period when the capacitor starts to discharge through R4 until the smoke alarm enters into self-test mode again.

If the battery fitted to the smoke alarm is in good condition, in self-test mode the voltage applied to the smoke alarm stabilizes at a value higher than the smoke alarm low battery threshold voltage and the current drawn by the smoke alarm is supplied in the main by the stand-by battery B1 of the smoke alarm. Since the voltage applied to the smoke alarm does not drop below the low battery threshold value, no audible warning is emitted.

Alarm Condition

Under alarm condition, the reactive primary power supply initially behaves as previously described for the self-test mode each time a higher current pulse is detected by the optocoupler OC1. Under the higher current pulses, the voltage at Point A drops and the battery takes over in supplying most of the current to the smoke alarm.

However, under alarm condition, capacitor C1 acquires enough charge to cause Q4 and hence Q3 to conduct after a period of time which normally is of a few seconds. As Q4 and Q3 conduct the voltage at point C drops to a very low value and transistor Q5 is turned off. As a result of this situation, the voltage at point B is raised to a voltage equal to the sum of the zener voltage ratings of Z1 and Z2 and the voltage at point A rises to the original 9.5 V d.c. This voltage is higher than the battery voltage and the smoke alarm is supplied with current exclusively from the reactive primary power supply for the rest of the alarm period. At the end of the alarm period, C1 starts discharging through R4 and the circuit is restored to its quiescent condition.

Referring to FIG. 3, apart from plugpack PP, all components including terminals T1 and T2 and resistor R5 and LED1 for primary power available indication are mounted in or on the smoke alarm as a separate "add-on" circuit. Alternatively, these components could be incorporated as part of the smoke alarm electronic circuit at time of manufacture.

Components D1–D3, Z1, Z2, Q1–Q5, R1–R4, OC1 and C1 thus constitute switching means such that when the voltage at point A drops below the voltage of stand-by battery B1 under self-test conditions the current drain is mainly via the stand-by battery B1 rather than via the primary power supply, whereas under quiescent conditions the current drain is via the primary power supply rather than via stand-by battery B1.

Figure 4:
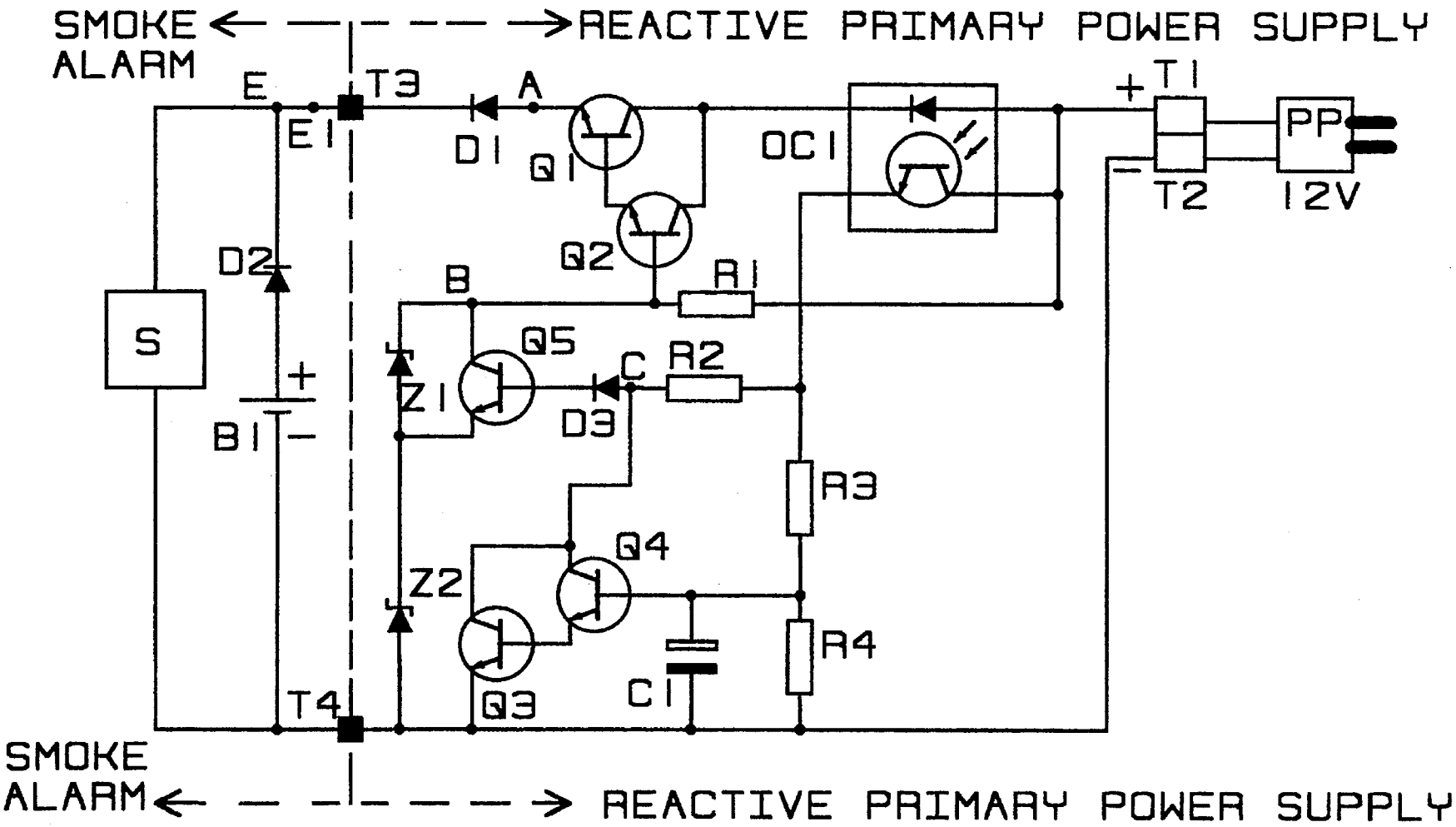
FIG. 4 is a circuit diagram of the second embodiment with connection to a separate reactive primary power system for a plurality of smoke alarms.

To reduce the total number of components and minimize on costs, it may be preferable, if the system includes more than one smoke alarm, to build the reactive primary power supply totally separate from the smoke alarm. The system is then wired as shown in FIG. 4 whose operation is essentially the same as that for the system according to FIG. 3 with the exception of:

(i) components R5 and LED1 for reactive power on indication are removed; and (ii) all smoke alarms are wired in parallel from terminals T3 and T4 of the reactive primary power supply. If an indication of external power availability is required in this system configuration, and LED can be provided in series with each smoke alarm reactive primary power supply line, between points E and E1 within each smoke alarm, which will glow when its corresponding smoke alarm is in self-test mode if external reactive primary power is available. If this option is chosen, diode D1 becomes redundant.

Third Embodiment

Figure 5:
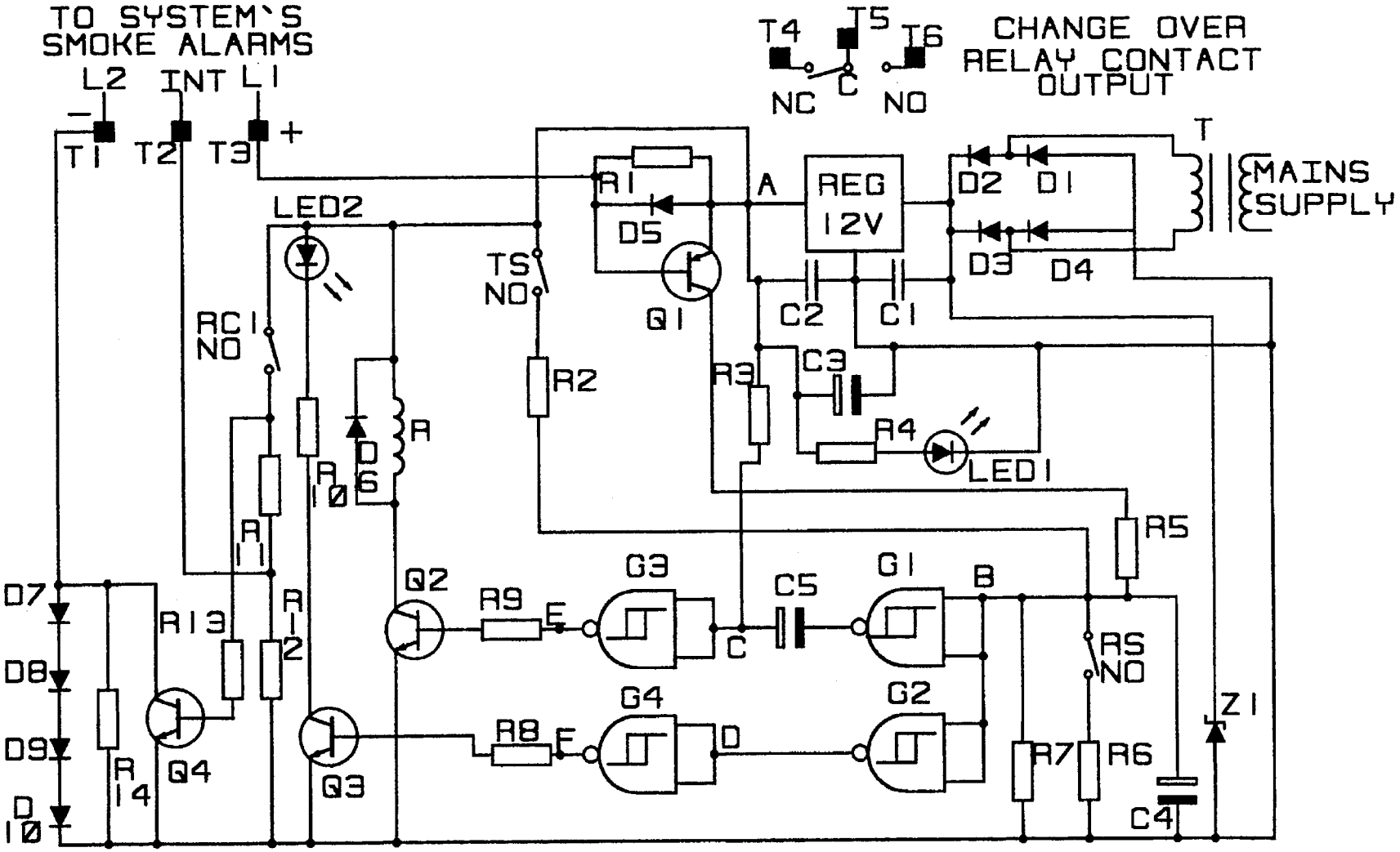
FIG. 5 is a circuit diagram of a third embodiment of the invention for use with a reactive primary power supply.
Figure 6:
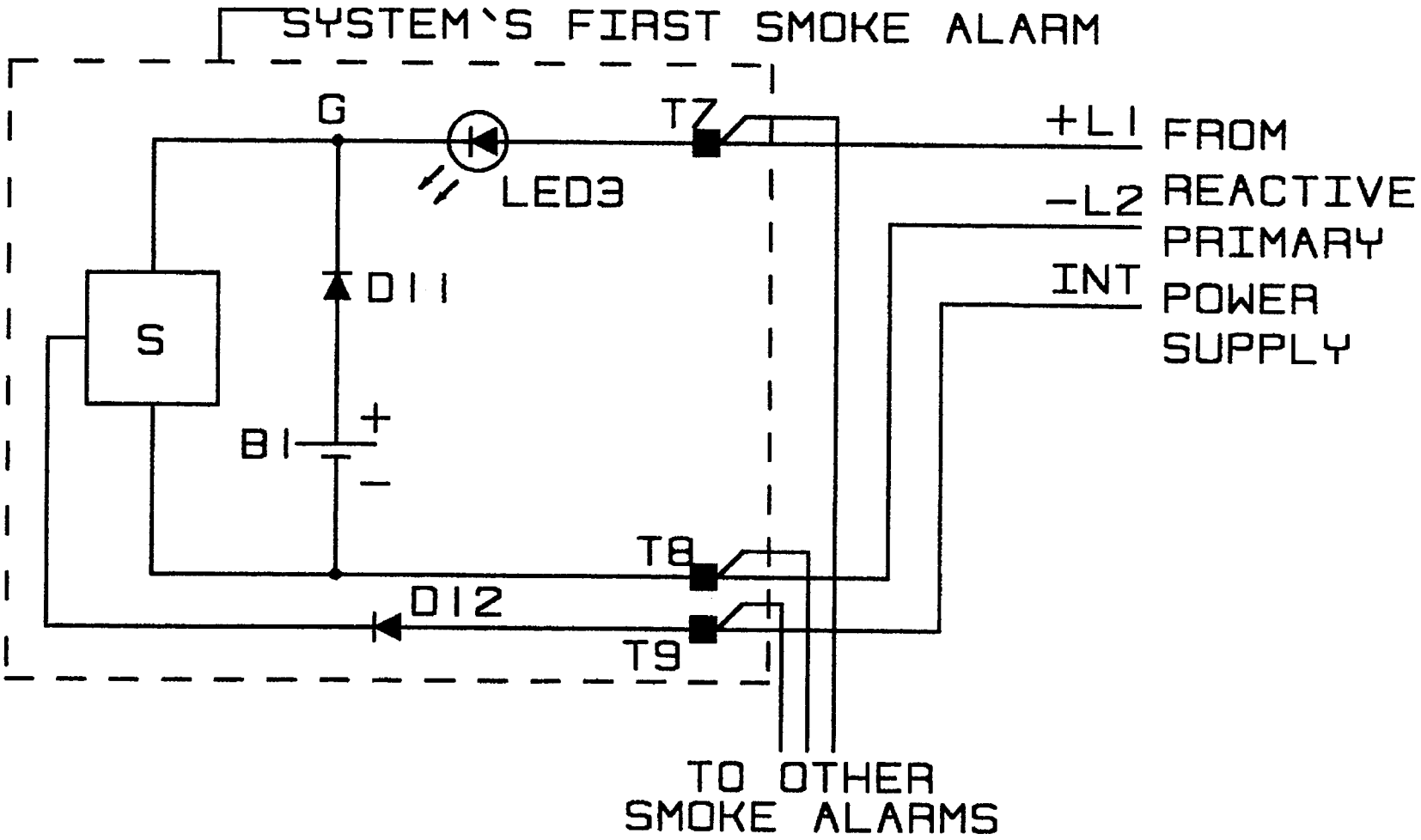
FIG. 6 is a circuit diagram illustrating a smoke alarm associated with the third embodiment.

In this form of the invention, the smoke detection and alarm system is wired as in FIG. 5, for the reactive primary power supply, and FIG. 6 for any of a plurality of smoke alarms included in the system. This form of the invention provides additional system features as follows:

(i) the reactive primary power supply includes means of remotely testing the smoke alarms included in the system; and (ii) the system smoke alarms include means of accepting a signal, on a third conductor, so as to cause them to be tested; and (iii) the reactive primary power supply includes means so as to provide an output to carry any of the following functions:

(a) activate a security system or any other monitoring system if the system is in alarm after smoke has been detected, (b) activate a sounder, flashing light or any other warning device if the system is in alarm;

(iv) the reactive primary power supply includes means to provide common alarm communication between all system smoke alarms so that if one smoke alarm detects smoke, all other smoke alarms forming part of the system are activated; and (v) the reactive primary power supply includes a timing circuit that allows the functions mentioned in section (iii) and (iv) above to time out after a set period so as not to cause any inconvenience as a result of the system remaining in alarm for a long period of time; and (vi) the reactive primary power supply further includes means by which the system can be reset should an alarm occur which causes the system to latch into alarm mode.

Referring to FIG. 5, the reactive primary power supply incorporates a 15 V stepdown transformer T connected to the mains supply system, rectifying diodes D1, D2, D3 and D4, a 12 V voltage regulator REG, decoupling capacitors C1 and C2, and a smoothing capacitor C3 to provide a regulated 12 V d.c. supply at point A of the circuit. LED1, in series with resistor R4, provides an indication at the reactive primary power supply that mains power is available. Zener diode Z1, rated 24 V 5W, is included to provide circuit surge protection.

Quiescent Condition

Under quiescent conditions and with a plurality of smoke alarms such as those illustrated in FIG. 6 connected in parallel across the positive and negative supply terminals of the reactive primary power supply, T3 and T1 respectively, the voltage drop across diode D5 in parallel with resistor R1 is negligible since the current flowing in R1 is of the order of microamps. A typical value of 0.3 V voltage drop with a value of R1 of 2000 ohms and a total 20 smoke alarms connected to the system.

The quiescent current drawn by the smoke alarms also flows through diodes D7, D8, D9 and D10, in parallel with R14, which are connected in the return path to ground of the reactive primary power supply. Under quiescent conditions, the voltage across these diodes and resistor R14 is also low. With 20 smoke alarms connected to the system, this voltage drop is also of the order of 0.3 V with a typical value for resistor R14 of 2000 ohms. Therefore, considering the above two voltage drops, the voltage available to power the smoke alarms connected to terminal T1 and T3 of the reactive primary power supply is of the order of 11.4 V under quiescent conditions. With reference to FIG. 6 this voltage is applied to the smoke alarm supply lines L1 and L2. The forward voltage drop of LED3 of the smoke alarm, of the order of 1.2 V under low quiescent current, results in the voltage at point G of all of the system smoke alarms being approximately 10.2 V. This voltage is higher than the 9 V battery voltage of the smoke alarm batteries B1 so that the smoke alarm diode D11 is reversed biased and the totality of the system quiescent current is supplied by the reactive primary power supply.

With reference again to FIG. 5 and under quiescent conditions, the 0.3 V drop across D5 and R1 is not sufficient to turn transistor Q1 on. Therefore the voltage across capacitor C4 is negligible so that the input to Schmidt trigger Nand gates G1 and G2 is low. This results in points C and D to be at logic high and in points E and F to be at logic low. Transistor Q2 and Q3 therefore do not conduct and LED2 is extinguished indicating that there is no alarm registered at the reactive primary power supply. Since Q2 is off, relay R does not operate and the relay changeover contact wired to terminals T4, T5 and T6 does not toggle. The other normally open contact of the relay, RC1, remains open and transistor Q4 is off.

Self-test Mode

If any of the system smoke alarms enters into self-test mode, the system operating current rises with the following effect:

(a) Smoke alarm battery missing or not connected

If the battery of the smoke alarm in self-test mode is missing or not connected, the increased current in self-test mode results in the voltage drop across the resistor R1 in parallel with diode D5 rising to the forward voltage drop of the diode, that is approximately 0.6 V. Similarly, the voltage drops across diodes D7, D8, D9 and D10 and LED3 of the smoke alarm in self-test mode to rise to 2.4 V and 2 volts respectively. The total voltage drop is therefore around 5 V so that the voltage at point G of the smoke alarm in self-test mode drops to seven volts, which is below the low battery threshold voltage of the smoke alarm. The smoke alarm in self-test mode emits a brief audible warning to indicate that the battery is missing or not connected. Whenever any of the smoke alarms of the system is in self-test mode, the 0.6 V drop across D5/R1 causes Q1 to conduct so that capacitor C4 starts charging through resistor R5. The time constant of the combination of R5 and C4 is made sufficiently large so that the charge acquired by capacitor C4 is not sufficient, under the brief self-test periods, to cause gates G1 and G2 to toggle.

The reactive power circuit, apart from decreasing the voltage made available at terminals T1 and T3, behaves in exactly the same manner as previously described for quiescent conditions when any of the system smoke alarms is being tested.

Resistor R7 across capacitor C4 ensures that the capacitor is slowly discharged in between the brief self-test periods.

(b) Smoke alarm battery low or depleted

If the battery of the smoke alarm in self-test mode is low or depleted, the voltage of both the battery and the reactive primary power supply will drop to cause the voltage at point G of the smoke alarm in self-test mode to stabilize at a voltage lower than the low battery threshold voltage of the smoke alarm. A brief audible warning is therefore emitted by the smoke alarm to indicate a low battery.

In self-test mode, most of the test current drawn by the smoke alarm is supplied by the smoke alarm battery since only a fraction of the test current is sufficient to cause the voltage of the reactive primary power supply to drop to a level which is below the low battery threshold voltage. With the value of R1 and R14 equal to 2000 ohms, this portion of the test current is less than 1.5 mA whereas the self-test current of smoke alarms are normally of the order of 10 mA or more.

(c) Smoke alarm battery in good condition

If the battery of the system smoke alarm is self-test mode is in good condition, although both the battery voltage and the voltage of the reactive primary power supply will drop under increased self-test current, the drops in voltage are insufficient to cause the voltage at point G of the smoke alarm in self-test mode to drop below the low battery threshold voltage. Therefore, the smoke alarm does not emit any audible warning.

Alarm Condition

Should one of the system smoke alarms detect smoke, a portion of the higher current drawn by the smoke alarm is derived from the reactive primary power supply to cause transistor Q1 to conduct. As a result of this, capacitor C4 starts to charge through resistor R5 and, after a period of time determined by the values of C4 and R5, the voltage at point B is raised sufficiently to cause the following:

(a) Gate G2 toggles and point D is brought to logic low to cause the output F of gate G4 to go high, thus turning transistor Q3 on so that the alarm LED, LED2, glows to indicate that the system has registered an alarm; and (b) Similarly, Gates G1 and G3 toggle to turn transistor Q2 and relay R on. The operation of the relay causes (i) the relay output changeover contact to toggle and this action may be used to trigger a security system, or any other monitoring system, or operate a warning device; and (ii) the relay contact RC1, which is normally open, to close. This action provides a voltage on the interconnect line of the system through the action of the potential divider R11 and R12. The closure of RC1 also has the effect of turning transistor Q4 fully on so that the total maximum voltage drops across R1 and R14 are both of the order of 0.6 V. Therefore, the output voltage of the reactive primary power supply only drops, under high alarm current pulses, to 10.8 V after an alarm has been registered.

The 10.8 V output of the reactive primary power supply is applied, through the system supply lines L1 and L2, to terminals T7 and T8 of the activated smoke alarm. This causes the voltage at point G of the activated smoke alarm to stabilize at around 8.8 V. Under such condition the stand-by battery supplies negligible current to the smoke alarm whose current demand is then met almost entirely by the reactive primary power supply.

Components D7–D10, R14, R1, Q4 and D5 as per FIG. 5 and components LED3 and D11 of FIG. 6 thus constitute switching means such that the current under self-test conditions causes the voltage at point G to drop and stabilise at a lower voltage, the current drain then being mainly via the stand-by battery B1 rather than via the primary power supply, whereas under quiescent conditions the current drain is via the primary power supply rather than via stand-by battery B1.

Common Alarm Communication

Smoke alarms incorporate a test switch, which when activated, causes the smoke alarm to be tested. Depending on the smoke alarm design, manual testing of the smoke alarm either grounds one side of the test switch or connects one side of the test switch to a voltage at or close to the supply voltage. This action results in the smoke alarm electronic circuitry to be activated and tested. FIG. 6 refers to smoke alarms which require one side of the test switch to be raised to a voltage close to the supply voltage for the purpose of testing.

As previously detailed, when an alarm is registered, the activation of relay R of the reactive primary power supply causes the interconnect supply line INT to be raised to a voltage close to the supply voltage of the primary power supply through the action of the potential divider R11/R12. This voltage is applied to all smoke alarm test switches through the smoke alarm diodes D12 (FIG. 6) to cause them to simultaneously test. Sounders of all smoke alarms are therefore activated provided common alarm communication between all system smoke alarms. Diode D12 of each smoke alarm is required so as to maintain the functionality of each smoke alarm test switch.

It is to be noted that, once the relay R (FIG. 5) of the reactive primary power supply is activated, the system latches into alarm mode as the energization of the system interconnect line INT causes the system current to further increase so as to maintain the capacitor C4 fully charged. Therefore, all smoke alarms of the system continue to sound until the timing circuit consisting of resistor R3 and capacitor C5 causes the voltage at point C to rise to logic high, making gate G3 toggle to de-activate the relay. This timing out of the alarm period, normally set between 60 and 300 seconds, minimizes the possibility of disturbances to the neighborhood should an alarm be raised when the premises are not occupied. After R3 and C5 time out, the interconnect line is de-energised through the deactivation of the relay R so that only the smoke alarm(s) which are detecting smoke will continue to sound. After all alarms are cleared, the system is automatically reset through the action of resistor R7 which slowly discharges capacitor C4 until gates G1 and G2 toggle back to their quiescent condition.

Remote Testing

Remote testing of the system smoke alarms is carried out by activating normally open test push button switch TS to quickly charge capacitor C4 and cause the test facility of each smoke alarm to be activated by the energization of the interconnect line INT. The system will remain in this mode and the smoke alarms will continue to sound until the timing circuit consisting of R3 and C5 times out. During that period, however, a walk through check can be carried out to ascertain that all smoke alarms are sounding to indicate good operational condition. If any smoke alarm is found to be silent when the system is in test mode, then that particular smoke alarm has failed the test.

Remote System Reset

It is sometimes practical and convenient to abort the alarm/warning raised by the system as exemplified by the following two cases:

(i) after a walk-through test is completed, it is not practical and convenient to wait for the system to time out, which could take several minutes, before the system is silenced or reset.

(ii) after an alarm has been registered, and before the system times out, it is not convenient to have sounders of all smoke alarms operating while the fire is investigated.

Therefore a normally open push button reset switch RS is provided which, when activated, causes capacitor C4 to quickly discharge through resistor R6 to reset the system. It is to be noted that if the system is reset, and a smoke alarm which is part of the system is still detecting smoke, the latter will be the only smoke alarm to continue to sound and this helps in determining the location where smoke was detected. If the smoke alarm continues to detect smoke, capacitor C4 starts to charge again and the process of system alarm detection is repeated until the system latches in alarm mode again.

It will be appreciated that whilst the condition of the stand-by battery of each smoke alarm is tested at regular intervals to provide an audible warning if the battery is depleted, disconnected or missing, the system and method of the present invention has a number of advantages including:

the stand-by battery of each smoke alarm supplies quiescent current only for very brief periods which results in the stand-by batteries having a longer life in excess of the average battery life common with existing systems, and the system is of low overall cost and of improved reliability.

We claim:

1. A method of monitoring and testing the integrity of a smoke detection and alarm system in which the smoke alarms are powered by a primary power supply, each smoke alarm having a stand-by battery power supply and being operable in a self-test mode, an alarm mode and a quiescent mode, the current drain in self-test and alarm modes exceeding the quiescent current drain, said method including:

switching the voltage supplied to the smoke alarms such that when the smoke alarms are in quiescent mode, the current drain is via the primary power supply, if available, and not via the stand-by battery power supply.

2. A method as claimed in claim 1, wherein said voltage is switched by:

providing a primary supply voltage which is slightly higher than the smoke alarm stand-by battery voltage;

detecting if a current higher than the quiescent current is supplied by the primary power supply in accordance with whether any of the smoke alarms is in alarm or self-test mode, and lowering the primary supply voltage when a current higher than the quiescent current is detected.

3. A method as claimed in claim 2, and including:

detecting when a current higher than the quiescent current is supplied by the primary power supply for a period of time exceeding the duration of the self-test mode, and raising the primary supply voltage to its original quiescent value when it is detected that a current higher than the quiescent current is supplied by the primary power supply for a period of time exceeding the duration of the self-test mode.

4. A method as claimed in claim 3, and including providing a warning if the integrity of the system is unsatisfactory.

5. A method as claimed in claim 1, and including providing a dedicated conductor independent of said primary power supply for connection to all smoke alarms in the system to establish common alarm communication means therebetween.

6. A method as claimed in claim 5, and including:

detecting an alarm registered at any smoke alarm in the system, and supplying an alarm signal to the dedicated conductor whereby other smoke alarms in the system are activated.

7. A method as claimed in claim 5, and including supplying a test signal to the dedicated conductor whereby testing of all smoke alarms in the system is activated.

8. A method as claimed in claim 7, wherein said test signal is supplied automatically after an alarm has been registered on the system.

9. A method as claimed in claim 7, wherein said test signal is supplied remotely by means of a test switch.

10. A method as claimed in claim 7, and including de-activating any warnings raised during testing.

11. A method as claimed in claim 10, wherein said warnings are de-activated automatically after a predetermined time.

12. A method as claimed in claim 10, wherein said warnings are de-activated remotely by means of a reset switch.

13. A smoke detection and alarm system including:

a primary power supply;

a plurality of smoke alarms powered by said primary power supply, each smoke alarm having a stand-by battery power supply and being operable in a self-test mode, an alarm mode or a quiescent mode, the current drain in self-test and alarm modes exceeding the quiescent current drain, and switching means for switching the voltage supplied to the smoke alarms such that when the smoke alarms are in quiescent mode, the current drain is via the primary power supply, if available, and not via the stand-by battery power supply.

14. A system as claimed in claim 13, wherein said switching means includes:

means for providing a primary supply voltage which is slightly higher than the smoke alarm stand-by battery voltage;

means for detecting if a current higher than the quiescent current is supplied by the primary power supply in accordance with whether any of the smoke alarms is in alarm or self-test mode, and means for lowering the primary supply voltage when a current higher than the quiescent current is detected.

15. A system as claimed in claim 14, and including:

means for detecting when a current higher than the quiescent current is supplied by the primary power supply for a period of time exceeding the duration of the self-test mode, and means for raising the primary supply voltage to its original quiescent value when it is detected that a current higher than the quiescent current is supplied by the primary power supply for a period of time exceeding the duration of the self-test mode.

16. A system as claimed in claim 15, and including warning means for providing a warning if the integrity of the system is unsatisfactory.

17. A system as claimed in claim 16, and including a dedicated conductor independent of said primary power supply for connection to all smoke alarms in the system to establish common alarm communication means therebetween.

18. A system as claimed in claim 17, and including remote alarm actuation means for detecting an alarm registered at any smoke alarm in the system and supplying an alarm signal to the dedicated conductor whereby other smoke alarms in the system are activated.

19. A smoke detection and alarm system as claimed in claim 18, wherein:

(1) said reactive primary power supply further comprises:

(a4) means of raising the d.c. supply voltage made available to power the system smoke alarms to its original quiescent value when a higher than quiescent current is detected for a period of time exceeding the duration of the self-test period; and (2) said smoke alarms further comprise:

(b3) means by which the higher than quiescent current following an alarm being raised, after a short initial period exceeding the duration of the self-test period, is caused to be supplied exclusively to the reactive primary power supply for the remainder of the alarm period.

20. A system as claimed in claim 17, and including test signal supply means for supplying a test signal to the dedicated conductor whereby testing of all smoke alarms in the system is activated.

21. A system as claimed in claim 20, wherein said test signal supply means supply said test signal automatically after an alarm has been registered on the system.

22. A system as claimed in claim 21, and including test switch means for supplying said test signal remotely.

23. A system as claimed in claim 17, and including connection means for connecting said smoke alarms and said switching means to a mains power supply system.

24. A system as claimed in claim 20, and including de-activating means for de-activating any warnings raised during testing.

25. A system as claimed in claim 24, wherein said de-activating means de-activates said warnings automatically after a predetermined time.

26. A system as claimed in claim 24, including reset switch means for de-activating said warnings remotely.

27. A smoke detection and alarm system including one or more low cost battery operated smoke alarms fitted with internal non-rechargeable stand-by batteries, a reactive primary power supply derived from mains supply, and connecting means for connecting the reactive primary power supply to each of the system smoke alarms, the system being characterised in that (1) said reactive primary power supply comprises:

(a1) means for providing a d.c. supply of slightly higher voltage than the smoke alarm stand-by battery voltage, and (a2) means for detecting the higher than quiescent current supplied by the reactive primary power supply when any of the smoke alarms connected as part of the system is in alarm or self-test mode, and (a3) means of lowering the d.c. supply voltage made available to power the system smoke alarms when a higher than quiescent current is detected; and (2) said smoke alarms comprise:

(b1) means by which all the current required under quiescent condition, with primary power available, is supplied by the reactive primary power supply, and (b2) means by which a very high proportion of the current required when any one of the system smoke alarms is in self test mode is supplied by the smoke alarm battery as the d.c. voltage of the reactive primary power supply drops in self test mode; and (3) all the above system characteristics resulting in:

(c1) the condition of the stand-by battery of each smoke alarm being tested at regular intervals to provide an audible warning if the battery is depleted, disconnected or missing, and (c2) the stand-by battery of each smoke alarm supplying current only for very brief periods to result in the stand-by batteries having a longer life well in excess of the average one year life common with existing systems; and (c3) the system being of very low overall cost and of much improved reliability.

* * * * *